US007111671B1

(12) United States Patent
Han

(10) Patent No.: US 7,111,671 B1
(45) Date of Patent: Sep. 26, 2006

(54) HEAT EXCHANGER HAVING AIR DRYING DEVICE

(75) Inventor: Hsien Sou Han, Taoyuan Hsien (TW)

(73) Assignee: Kaori Heat Treatment Co., Ltd., Taoyuan Hsien (TW)

( * ) Notice: Subject to any disclaimer, the term of this patent is extended or adjusted under 35 U.S.C. 154(b) by 0 days.

(21) Appl. No.: 11/258,451

(22) Filed: Oct. 25, 2005

(51) Int. Cl.
*F28F 9/02* (2006.01)
*F28D 1/02* (2006.01)

(52) U.S. Cl. ..... 165/164; 165/165; 165/153

(58) Field of Classification Search ..... 165/164, 165/165–166, 172–175, 157–158, 153–154, 165/140, 144; 96/189, 218, 219
See application file for complete search history.

(56) References Cited

U.S. PATENT DOCUMENTS 1,900,504 A * 3/1933 Kirgan ..... 165/104.31
2,360,408 A * 10/1944 Dunn et al. ..... 165/140
4,093,022 A 6/1978 Polyak, Jr. ..... 165/39
4,319,630 A * 3/1982 Hronek et al. ..... 165/70
4,620,588 A * 11/1986 Pfouts et al. ..... 165/285
4,653,575 A * 3/1987 Courchesne ..... 165/54
6,328,100 B1 * 12/2001 Haussmann ..... 165/176
6,390,185 B1 * 5/2002 Proeschel ..... 165/155

FOREIGN PATENT DOCUMENTS

JP 57002980 A * 1/1982
JP 02279989 A * 11/1990

* cited by examiner

*Primary Examiner*—Tho Duong
(74) *Attorney, Agent, or Firm*—Charles E. Baxley

(57) ABSTRACT

A heat exchanger includes a container having an outlet and an entrance coupled to an inlet and an exit, a receptacle having an entering port and a discharging port for circulating a fluid medium and having an entering opening and a discharging opening. A casing is disposed between the container and the receptacle and includes a passage coupled between the outlet of the container and the entering opening of the receptacle, to allow a heat medium to flow from the container into the receptacle, and a chamber communicating with the discharging opening of the receptacle and the entrance of the container. An air filtering device may be disposed in the casing for air filtering purposes, and for collecting and discharging water.

8 Claims, 3 Drawing Sheets

HEAT EXCHANGER HAVING AIR DRYING DEVICE

BACKGROUND OF THE INVENTION

1. Field of the Invention

The present invention relates to a heat exchanger, and more particularly to a heat exchanger having an air filtering or drying structure or device, for filtering or removing or collecting water, or for water condensing purposes.

2. Description of the Prior Art

Typical heat exchangers comprise a receptacle including a chamber formed therein for receiving a heat medium, such as water or fluid, and an inlet and an outlet provided therein for allowing the heat medium or water or fluid to flow into and out of the chamber of the receptacle. The receptacle further includes a number of axially and/or laterally extended tubes disposed therein, and arranged to allow ambient air to flow into and out of the tubes, and thus to allow the water or fluid and the ambient air to be heat exchanged indirectly within the chamber of the receptacle.

For example, U.S. Pat. No. 4,093,022 to Polyak, Jr. discloses one of the typical heat exchangers which also comprises a cylindrical receptacle including a chamber formed therein for receiving a heated fluid, and including an inlet and an outlet provided therein for allowing the heated fluid to flow into and out of the chamber of the receptacle. The receptacle also includes a number of laterally and/or axially-extending tubes disposed therein, and arranged to allow ambient air to flow or to be pumped or cycled through the tubes, and thus to allow the water or fluid and the ambient air to be heat exchanged indirectly within the chamber of the receptacle.

Normally, the ambient air may include water or fluid contained therein, and the water or fluid contained within the ambient air may be condensed while or after the heat exchanging operation. For filtering or removing the water or fluid from the ambient air, an additional air drying device or apparatus is required to be provided and coupled to the cylindrical receptacle, or to the tubes.

The present invention has arisen to mitigate and/or obviate the afore-described disadvantages of the conventional heat exchangers.

SUMMARY OF THE INVENTION

The primary objective of the present invention is to provide a heat exchanger including an air filtering or drying structure or device provided therein, for easily and readily filtering or removing or collecting water, or for water condensing purposes, without additional air drying device or apparatus.

In accordance with one aspect of the invention, there is provided a heat exchanger comprising a container including an inlet and an exit formed in a front portion thereof, and including an outlet and an entrance formed in a rear portion thereof and coupled to the inlet and the exit thereof respectively, the inlet of the container being provided for receiving a heat medium, a receptacle including an entering port and a discharging port provided in a rear portion thereof and coupled together, for allowing a fluid medium to flow into and out of the receptacle, and including an entering opening and a discharging opening provided therein and coupled together, and a casing disposed between the container and the receptacle and including a passage formed therein and defined by a duct, and coupled between the outlet of the container and the entering opening of the receptacle, to allow the heat medium to flow from the container into the receptacle, and out through the discharging opening of the receptacle, and the casing including a chamber formed therein and communicating with the discharging opening of the receptacle and the entrance of the container, for allowing the heat medium to flow from the receptacle into the container again after heat exchanging with the fluid medium.

The inlet and the outlet of the container are preferably arranged diagonally. The entrance and the exit of the container are also preferably arranged diagonally. The entering port and the discharging port of the receptacle are also preferably arranged diagonally.

The discharging opening of the receptacle includes a cross sectional area greater than that of the entering opening of the receptacle, to allow the heat medium to flow from the entering opening to the discharging opening of the receptacle in a decreased flowing speed.

The chamber of the casing includes a cross sectional area greater than that of the passage of the casing, to allow the heat medium to flow through the casing and into the container in a decreased flowing speed.

The casing includes an air filtering device disposed therein, and disposed between the discharging opening of the receptacle and the entrance of the container, for air filtering purposes. The casing includes a discharge orifice formed in the bottom portion thereof, for receiving and collecting and discharging water filtered from the heat medium, such that the heat medium may be easily and readily filtered or dried.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
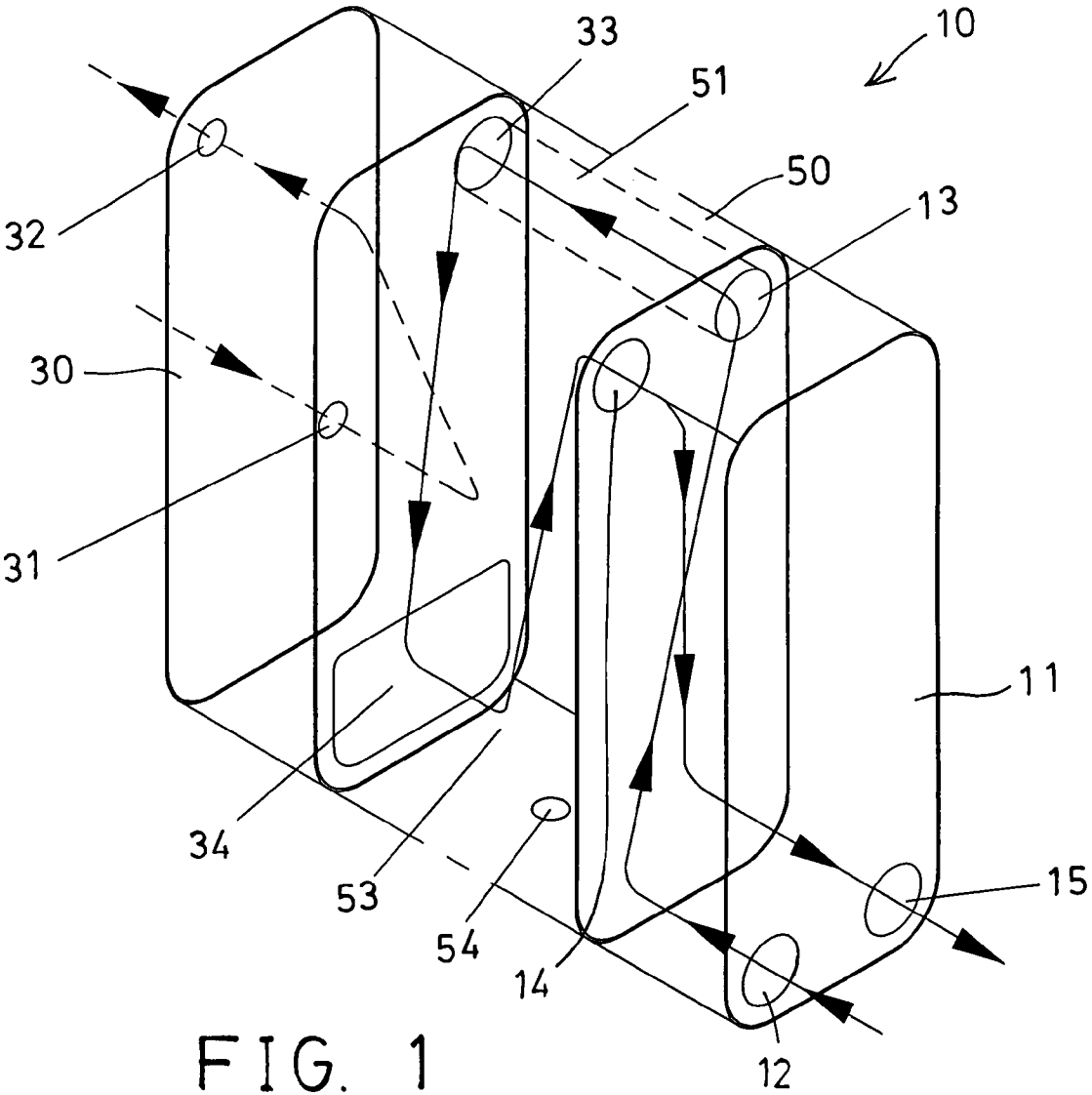
FIG. 1 is a perspective view of a heat exchanger in accordance with the present invention.
Figure 2:
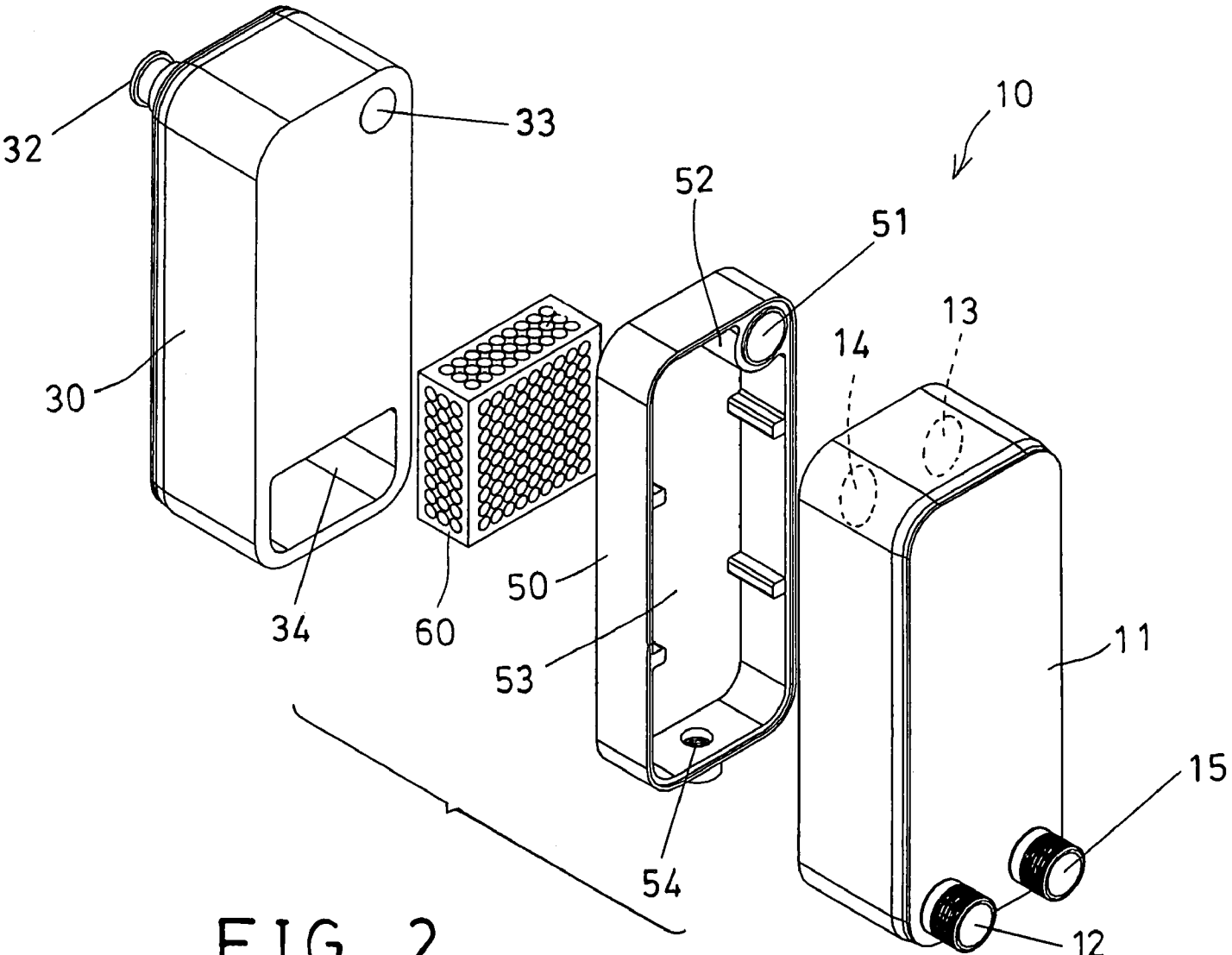
FIG. 2 is a partial exploded view of the heat exchanger, as seen from the front or one direction thereof.
Figure 3:
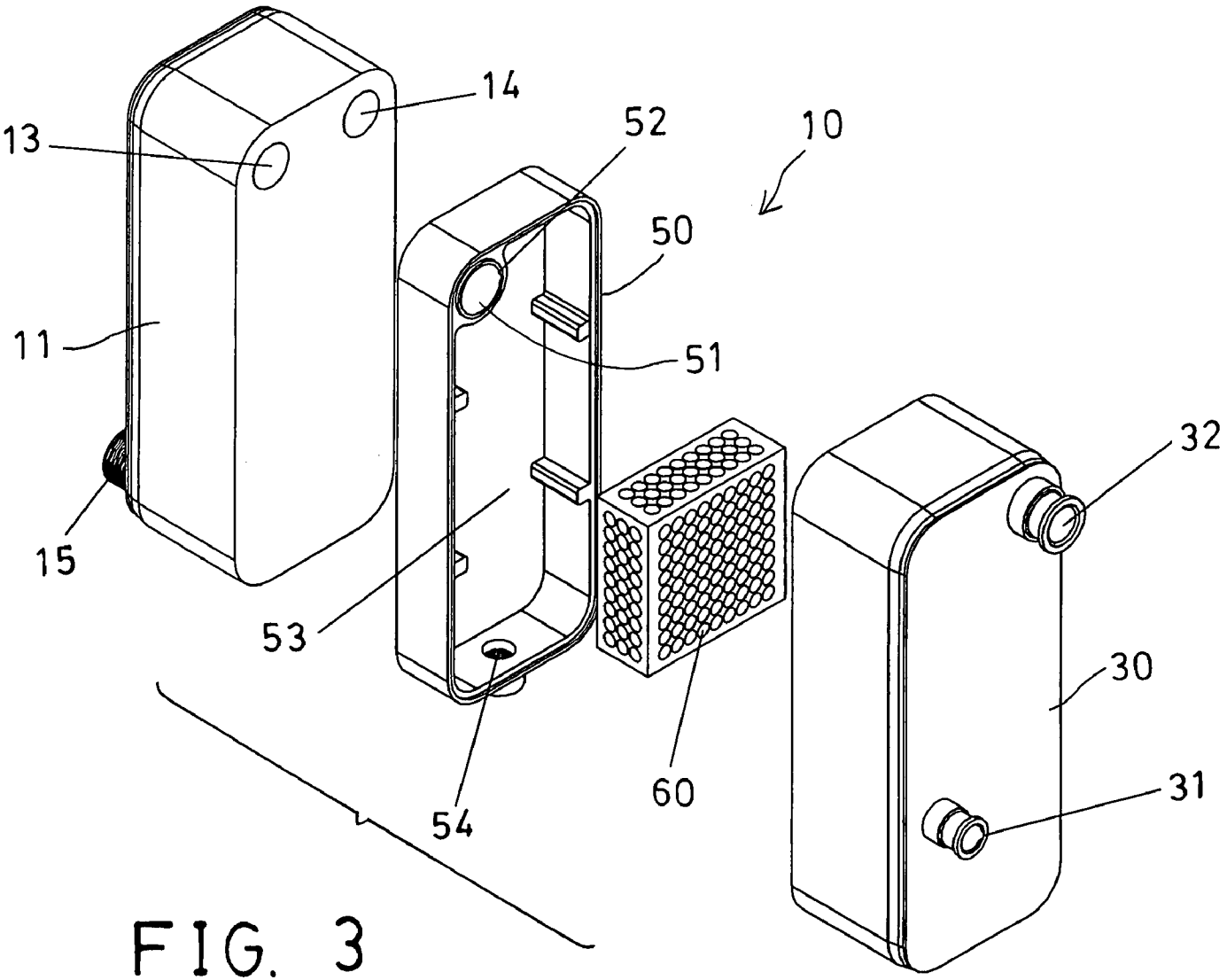
FIG. 3 is another partial exploded view of the heat exchanger, as seen from the rear or opposite direction thereof.

Referring to the drawings, a heat exchanger 10 in accordance with the present invention comprises a container 11, a receptacle 30, and a casing 50 disposed and secured between the container 11 and the receptacle 30 with such as fasteners (not shown), adhesive materials, or by welding processes. The container 11, the receptacle 30, and the casing 50 each may include a number of axially and/or laterally extending tubes or fins disposed therein, and arranged for heat exchanging purposes, which are typical and will not be described in further details.

The container 11 includes an inlet 12 and an outlet 13 formed therein, such as formed in the front and the rear portions thereof respectively, and preferably arranged diagonally, and having a number of tubes coupled therebetween (not shown). However, the inlet 12 and the outlet 13 are preferably coupled together or communicating with each other, and arranged to receive a selected heat medium, such as the ambient air, or to allow the selected heat medium to flow into and out of or through the container 11, as indicated in solid lines in FIG. 1.

The container 11 further includes an entrance 14 and an exit 15 formed therein, such as formed in the rear and the front portions thereof respectively, and preferably arranged diagonally, and having a number of tubes coupled therebetween (not shown). However, the entrance 14 and the exit 15 are also preferably coupled together or communicating with each other, and arranged to allow the heat medium or the ambient air to flow into and out of or through the container 11, after heat exchanging operations, as also indicated in solid lines in FIG. 1.

The receptacle 30 includes an entering port 31 and a discharging port 32 formed or provided therein, such as formed in the rear portion thereof, and also preferably arranged diagonally, and having a number of tubes coupled therebetween (not shown). The entering port 31 and the discharging port 32 are coupled together or communicating with each other, and arranged to allow the other heat medium or fluid medium, such as water or fluid to flow into and out of or through the receptacle 30, as indicated in dotted lines in FIG. 1, and/or for heat exchanging with the ambient air indirectly.

The receptacle 30 further includes an entering opening 33 and a discharging opening 34 formed or provided therein, such as formed in the front portion thereof, and also preferably arranged diagonally or spaced away from each other, and having a number of tubes coupled therebetween (not shown). The entering opening 33 and the discharging opening 34 are also coupled together or communicating with each other, and arranged to allow the ambient air to flow into and out of or through the receptacle 30, as indicated in dotted lines in FIG. 1, and/or for heat exchanging with the water or fluid indirectly.

The casing 50 includes a passage 51 formed therein and defined by a duct 52, and communicating with or coupled between the outlet 13 of the container 11 and the entering opening 33 of the receptacle 30, and arranged to allow the ambient air to flow from the container 11 into and through the receptacle 30, as indicated in dotted lines in FIG. 1, for heat exchanging with the water or fluid indirectly. The casing 50 further includes a chamber 53 formed or provided therein, and communicating with the discharging opening 34 of the receptacle 30 and the entrance 14 of the container 11, and arranged for allowing the ambient air to flow from the receptacle 30 into and through the container 11 again, after heat exchanging operations.

The heat exchanger 10 further includes an air filtering or drying screen or device 60 provided or disposed in the chamber 53 of the casing 50, and disposed or located within the air flowing path that is formed or provided between the discharging opening 34 of the receptacle 30 and the entrance 14 of the container 11. The air filtering device 60 is arranged to allow air to flow therethrough, and to filter or remove or collect water or fluid, or for water condensing purposes from the ambient air, and thus for drying the ambient air, and for allowing the dried ambient air to flow out through the exit 15 of the container 11. The casing 50 further includes a discharge orifice 54 formed therein, such as formed in the lower or the bottom portion thereof, for receiving and collecting and discharging the water that may be filtered or removed or condensed from the ambient air.

It is preferable that the discharging opening 34 of the receptacle 30 includes a cross sectional area or volume greater than that of the entering opening 33 of the receptacle 30, and the chamber 53 of the casing 50 also includes a cross sectional area or volume greater than that of the passage 51 of the casing 50, to allow the ambient air to flow from the receptacle 30 through the casing 50 and into the container 11 in a much slower or decreased flowing speed, and thus to allow the water or fluid to be suitably filtered or removed or condensed from the ambient air.

Accordingly, the heat exchanger in accordance with the present invention includes an air filtering or drying structure or device provided therein, for easily and readily filtering or removing or collecting water, or for water condensing purposes, without additional air drying device or apparatus.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A heat exchanger comprising:

a container including an inlet and an exit formed in a front portion thereof, and including an outlet and an entrance formed in a rear portion thereof and coupled to said inlet and said exit thereof respectively, said inlet of said container being provided for receiving a heat medium, a receptacle including an entering port and a discharging port provided in a rear portion thereof and coupled together, for allowing a fluid medium to flow into and out of said receptacle, and including an entering opening and a discharging opening provided therein and coupled together, and a casing disposed between said container and said receptacle and including a passage formed therein and defined by a duct, and coupled between said outlet of said container and said entering opening of said receptacle, to allow the heat medium to flow from said container into said receptacle, and out through said discharging opening of said receptacle, and said casing including a chamber formed therein and communicating with said discharging opening of said receptacle and said entrance of said container, for allowing the heat medium to flow from said receptacle into said container again after heat exchanging with the fluid medium.

2. The heat exchanger as claimed in claim 1, wherein said inlet and said outlet of said container are arranged diagonally.

3. The heat exchanger as claimed in claim 1, wherein said entrance and said exit of said container are arranged diagonally.

4. The heat exchanger as claimed in claim 1, wherein said entering port and said discharging port of said receptacle are arranged diagonally.

5. The heat exchanger as claimed in claim 1, wherein said discharging opening of said receptacle includes a cross sectional area greater than that of said entering opening of said receptacle, to allow the heat medium to flow from said entering opening to said discharging opening of said receptacle in a decreased flowing speed.

6. The heat exchanger as claimed in claim 1, wherein said chamber of said casing includes a cross sectional area greater than that of said passage of said casing, to allow the heat medium to flow through said casing and into said container in a decreased flowing speed.

7. The heat exchanger as claimed in claim 1, wherein said casing includes an air filtering device disposed therein, and disposed between said discharging opening of said receptacle and said entrance of said container, for air filtering purposes.

8. The heat exchanger as claimed in claim 7, wherein said casing includes a discharge orifice formed in bottom thereof, for receiving and collecting and discharging water filtered from the heat medium.

* * * * *